US006573495B2

(12) United States Patent
Senko

(10) Patent No.: US 6,573,495 B2
(45) Date of Patent: Jun. 3, 2003

(54) HIGH CAPACITY ION CYCLOTRON RESONANCE CELL

(75) Inventor: Michael Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 317 days.

(21) Appl. No.: 09/750,503

(22) Filed: Dec. 26, 2000

(65) Prior Publication Data

US 2002/0079444 A1 Jun. 27, 2002

(51) Int. Cl.[7] ..... H01J 49/38

(52) U.S. Cl. ..... 250/290; 250/291; 250/292; 250/423 R

(58) Field of Search ..... 250/290, 291, 250/292, 293, 423 R

(56) References Cited

U.S. PATENT DOCUMENTS

| | | | | |
|---|---|---|---|---|
| 4,924,089 A | | 5/1990 | Caravatti | 250/290 |
| 4,931,640 A | * | 6/1990 | Marshall et al. | 250/291 |
| 5,019,706 A | | 5/1991 | Allemann et al. | 250/291 |
| 5,389,784 A | * | 2/1995 | Weller | 250/291 |
| 5,650,617 A | | 7/1997 | Mordehai | 250/290 |

OTHER PUBLICATIONS

Beu et al., "Open Trapped Ion Cell Geometries For Fourier Transform Ion Cyclotron Resonance Mass Spectrometry," Elsevier Science Publishers B.V., Amsterdam, 1992, pp. 215–230.

Caravatti et al., "The 'Infinity Cell': A New Trapped–ion Cell With Radiofrequency Covered Trapping Electrodes For Fourier Tansform Ion Cyclotron Resonance Mass Spectrometry," John Wiley & Sons, Ltd., 1991, pp. 514–518.

Chen et al., "An Off–Center Cubic Ion Trap For Fourier Transform Ion Cyclotron Resonance Mass Spectrometry," MASPEC Compuscript, Jan. 1994, pp. 1–10.

Guan et al., "Off–axis Injection Into An ICR Ion Trap: A Means For Efficient Capture Of A Continuous Beam Of Externally Generated Ions," Elsevier Science B.V., 1994, pp. 75–86.

Lee et al., "A New Cylindrical Trapped Ion ICR Cell", Institute of Physical and Theoretical Chemistry, University of Frankfurt, Germany, pp. 1645–1649.

Marto et al., "A Two–Electrode Ion Trap For Fourier Transform Ion Cyclotron Resonance Mass Spectrometry," Elsevier Science B.V., 1994, pp. 9–30.

Rempel et al, "Parametric Mode Operation Of A Hyperbolic Penning Trap For Fourier Transform Mass Spectrometry," American Chemical Society, 1987, pp. 2527–2532.

Winger et al., "High Throughput, High Speed, Automated Accurate Mass LC–FT/MS Analysis," Finnigan Corporation, p. 516.

* cited by examiner

*Primary Examiner*—John R. Lee
*Assistant Examiner*—Nikita Wells
(74) *Attorney, Agent, or Firm*—Dorsey & Whitney LLP

(57) ABSTRACT

An ion cyclotron resonance cell having a large ion trapping volume is described. The cell includes elongated spaced concentric electrodes having a common axis in which the trapping volume is the space between the electrodes. The cell may also include trapping electrodes disposed at the ends of the elongated concentric electrodes.

12 Claims, 2 Drawing Sheets

HIGH CAPACITY ION CYCLOTRON RESONANCE CELL

BRIEF DESCRIPTION OF THE INVENTION

This invention relates generally to an ion cyclotron resonance (ICR) cell, and more particularly to an ICR cell with large ion storage capacity.

BACKGROUND OF THE INVENTION

Ion cyclotron resonance is well known and has been employed in numerous spectroscopy devices and studies. Generally, these devices store the ions to be analyzed in cells of various configurations which are disposed in a uniform magnetic field. Gaseous ions in the presence of the uniform magnetic field are constrained to move in circular orbits in a plane perpendicular to the field (cyclotron oscillations). The ions are not constrained in their motion parallel to the field. As a consequence, various cell configurations have been adopted to retain the ions within the cell. For example, the cell may include end plates which have dc voltages applied thereto, or it may be of an open cell design such as described by Beu et. al., "Open trapped ion cell geometries for FT/ICR/MS, *Int. J. Mass Spectrom. Ion Processes*, 112 (1992), 215–230. Another cell configuration is described in U.S. Pat. No. 5,019,706.

The frequency of the circular motion is directly dependent upon the charge-to-mass ratio of the ions and the strength of the magnetic field. When orbiting ions trapped within the cell are subjected to an oscillating electric field, disposed at right angles to the magnetic field, the ions having a cyclotron frequency equal to the frequency of the oscillating electric field are accelerated to increasingly larger orbital radii and higher kinetic energy. Because only the resonant ions absorb energy from the oscillating field, they are distinguished from the non-resonant ions upon which the oscillating electric field has a substantially negligible effect. The oscillating ions are detected by separate electrodes which have image current induced therein by the oscillating ions. In another example, the cell does not include separate detection electrodes, and is operated in a switched mode. A two-electrode ion trap is described by Marto, et al., "A Two-Electrode Ion Trap for Fourier Transform Ion Cyclotron Resonance Mass Spectrometry", *Int. J. Mass Spectrom. Ion Processes*, 137 (1994), 9–30.

Generally, the ions are excited by a pulsed wave form having multiple frequencies whereby ions of different masses undergo ion cyclotron resonance. Comisarow and Marshall in U.S. Pat. No. 3,937,955 describes the operation of an ICR cell excited with waveforms having multiple frequencies in what is known as a Fourier transform mode (FT-ICR). It has been recently demonstrated that one of the primary limitations to obtaining accurate mass measurement for FT-ICR is space charge-induced shifts of the cyclotron frequency. These shifts can be minimized by having a reproducible number of ions during each scan (Winger, et al., "High Throughput, High Speed, Automated Accurate Mass LC-FT/MS Analysis", *Proc. 46th ASMS* (1998), p. 516).

Other FT-ICR systems are less sensitive to space charge-induced shifts and therefore produce more reliable mass accuracy data. For example, the infinity cell (Caravatti et al., "The Infinity Cell: a new Trapped-ion Cell With Radio-frequency Covered Trapping Electrodes for Fourier Transform Ion Cyclotron Resonance Mass Spectrometry", *Org. Mass Spectrom.,* 26 (1991), 514–518) (Allemann et al., "Ion Cyclotron Resonance Spectrometer", U.S. Pat. No. 5,019,706), which uses a linearized dipolar field which allows a greater ion excitation radius and the use of "side-kick" injection (Caravatti, Pablo, "Method and apparatus for the accumulation of ions in a trap of an ion cyclotron resonance spectrometer, by transferring the kinetic energy of the motion parallel to the magnetic field into direction perpendicular to the magnetic field", U.S. Pat. No. 4,924,089), which gives the ions an initial non-zero magnetron radius. Both of these features contribute to lower ion density and thus a reduced sensitivity to space charge-induced frequency shifts.

The primary drawback to a non-zero initial magnetron radius is that the acquired signal will contain significant harmonic content and other modulations of the fundamental signal (Chen et al., "An off-center cubic ion trap for Fourier transform ion cyclotron resonance mass spectrometry", *Int. J. Mass Spectrom. Ion Processes,* 133 (1994), 29–38). One method which allows the formation of an off-axis ion cloud without the observation of higher-order harmonics is the use of a two-electrode trap such as described by Marto et. al., "A Two-Electrode Ion Trap for Fourier Transform Ion Cyclotron Resonance Mass Spectrometry", *Int. J. Mass Spectrom. Ion Processes,* 137 (1994), 9–30. This trap has been shown to be an order of magnitude less sensitive to space charge shifts than a standard cubic trap. The primary disadvantage of the two-electrode trap is the severe axial ejection caused by the parametric excitation and significant axial fields.

OBJECTS AND SUMMARY OF THE INVENTION

It is an object of the present invention to provide an improved ICR cell.

It is a further object of the present invention to provide an ICR cell in which the ion cloud is off-axis.

It is a further object of the present invention to provide an ICR cell in which space charge-induced shifts are minimized.

The foregoing and other objects of the invention are achieved by an ICR cell which comprises two concentric elongated electrodes and trapping electrodes disposed at the ends of the concentric electrodes to form an ion trapping volume in the space between the concentric electrodes.

BRIEF DESCRIPTION OF THE DRAWINGS

The foregoing and other objects of the invention will be more clearly understood from the following description when read in conjunction with the accompanying drawings in which.

DESCRIPTION OF PREFERRED EMBODIMENTS

Figure 1:
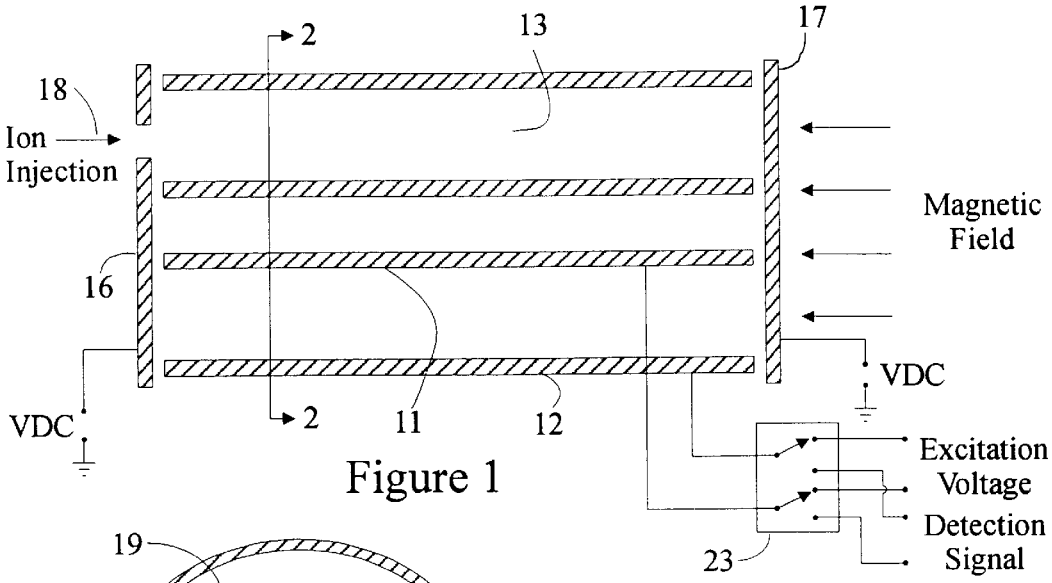
FIG. 1 is a sectional view of an ICR cell with two concentric cylindrical electrodes and end trapping electrodes disposed perpendicular to the magnetic field.
Figure 2:
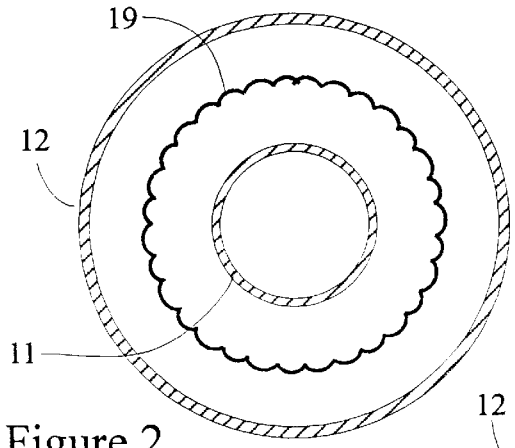
FIG. 2 is a sectional view taken along the line 2—2 of FIG. 1.
Figure 3:
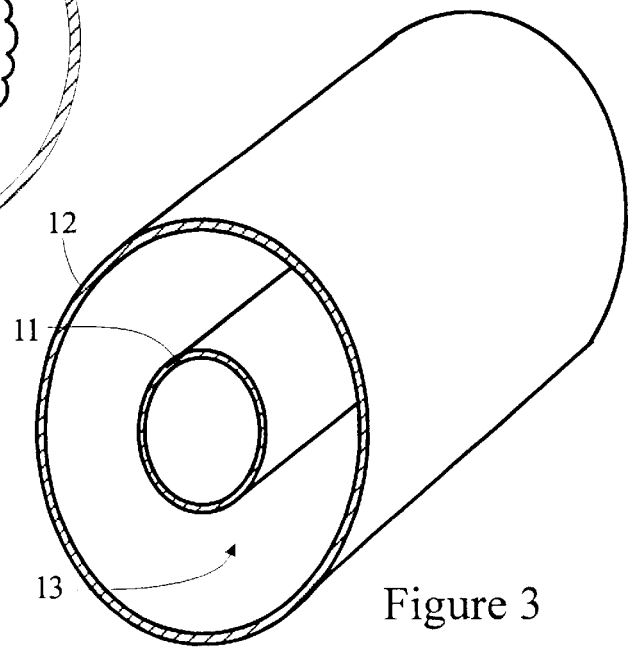
FIG. 3 is a perspective view of the cell of FIGS. 1 and 2.

Referring to FIGS. 1, 2 and 3, an ICR cell in accordance with one embodiment of the invention is illustrated. The cell includes spaced hollow cylindrical electrodes 11 and 12 which define an annular trapping space 13. Although shown as a hollow electrode, the electrode 11 need not be a hollow electrode.

Trapping electrodes 16 and 17 perpendicular to the magnetic field are spaced from the ends of the cylindrical electrodes and, as is well known, serve to confine ions within the trapping region 13. Ions are introduced into the region 13 by injecting off-axis from a suitable external source as indicated by the arrow 18. The off-axis injection provides a component of ion travel which is perpendicular to the magnetic field, and gives rise to magnetron motion as indicated by the curve 19, FIG. 2, in which the ions orbit around the central cylinder. This orbiting reduces the axial velocity of the ions and provides a greater dwell time within the ion trap. The ion trap is shown disposed in a uniform magnetic field and is enclosed within an evacuated chamber or envelope (not shown). Alternatively, the ions can be formed by bombarding molecules within the trapping volume with an ion beam, that is the ions are formed in the trapping volume.

In operation, a dc voltage (VDC) is applied to the trapping electrodes. The two-electrode cyclotron resonance cell is operated by applying a broad-frequency band excitation pulse between the electrodes to form radially-extending electric fields which cause the ions to absorb energy and oscillate in the radial direction. After the excitation pulse is applied, the electronic switch 23 is switched to the detect mode where image currents induced by the cyclotron motion of the ions are detected. The image currents are processed as for example by the Fourier Transform method taught in U.S. Pat. No. 3,937,955. The action of the off-axis injection produces an actual magnetron motion of the ions and causes them to orbit about the inner electrode which significantly reduces the ion densities relative to a traditional ion trap.

Figure 4:
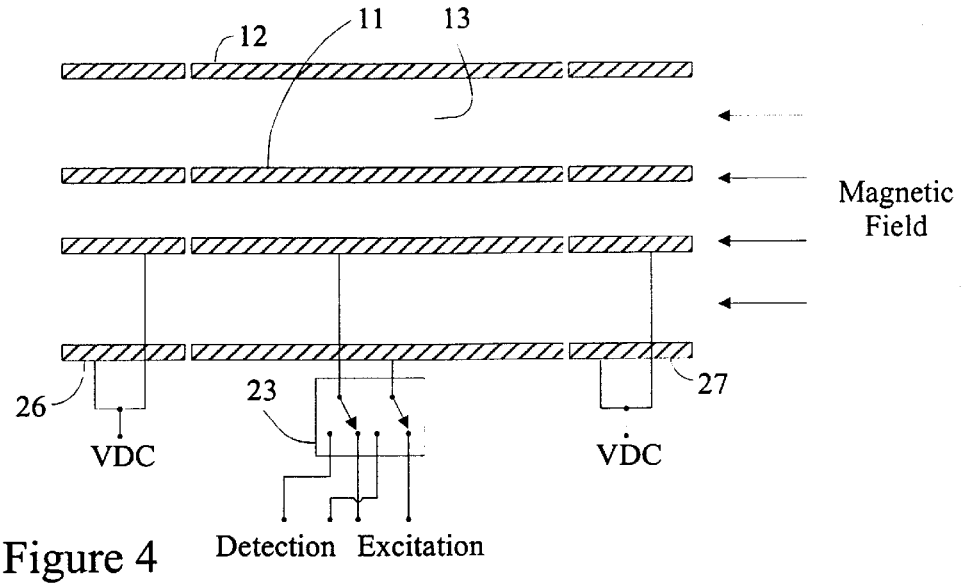
FIG. 4 is a sectional view of an ICR cell with concentric cylindrical electrodes and end trapping electrodes disposed parallel to the magnetic field.

FIG. 4 shows an ICR cell in which the hollow trapping electrodes 26 and 27 are concentric electrodes disposed parallel to the magnetic field. This type of open-cell design is described in Beu et al. article entitled: "Open trapped ion cell geometries for FT/ICR/MS", *Int. J. Mass Spectrom. Ion Processes,* 112 (1992) 215–230. In all other respects, the cell is operated as described above.

Figure 5:
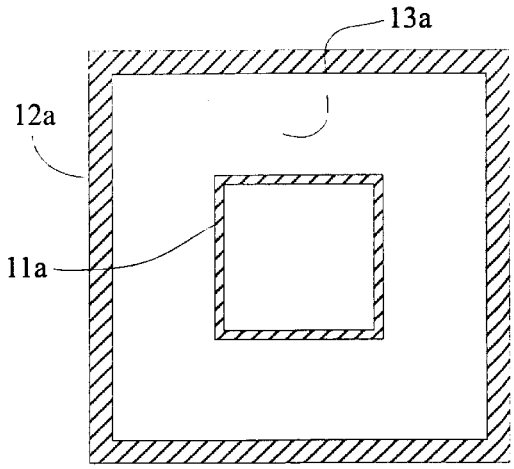
FIG. 5 is an end view of an ICR cell with spaced square concentric electrodes.
Figure 6:
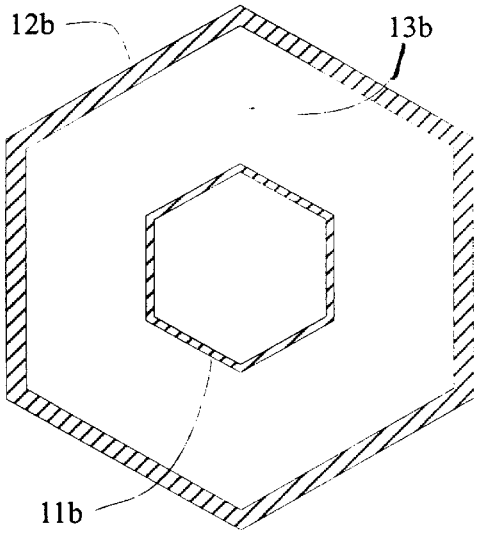
FIG. 6 is an end view of an ICR cell with spaced hexagonal concentric electrodes.

FIG. 5 is a sectional view showing an ion cyclotron resonance cell in which the concentric electrodes 11*a*, 12*a* are rectangular tubes. Trapping electrodes are disposed at the ends of the tubes. The ICR cell operates substantially as described above. FIG. 6 shows an ion cyclotron resonance cell which has tubular electrodes of a hexagonal shape. It is understood, however, that, although circular cylindrical cells are preferred, electrodes comprising concentric square tubes, hexagonal tubes or other configurations will work as described above. Thus, there has been disclosed an ICR cell with an increased storage space thereby minimizing space charge effects.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. An ion cyclotron resonance cell comprising first and second elongated spaced concentric electrodes having a common axis to define in the space therebetween an ion trapping volume formed by the by the concentric electrodes; and trapping electrodes disposed at the ends of said elongated first and second electrodes.

2. An ion cyclotron resonance cell as in claim 1 including trapping electrodes disposed at the ends of said elongated electrodes.

3. An ion cyclotron resonance cell as in claim 1 in which the elongated spaced electrodes are parallel to one another.

4. An ion cyclotron resonance cell as in claims 2 or 3 in which the elongated electrodes are cylindrical tubes.

5. An ion cyclotron resonance cell as in claim 2 or 3 in which the elongated electrodes are square tubes.

6. An ion cyclotron resonance cell as in claim 2 or 3 in which the elongated electrodes are multi-sided tubes.

7. An ion cyclotron resonance cell as in claim 2 in which the trapping electrodes are disposed perpendicular to the axis of the cell.

8. An ion cyclotron resonance cell as in claim 2 in which the trapping electrodes are disposed parallel to the axis of the cell.

9. An ion cyclotron resonance cell comprising a first elongated hollow outer electrode, a smaller second elongated electrode within the first electrode to define a concentric ion trapping volume in the space therebetween, mapping electrodes disposed at the ends of the elongated first and second electrodes, switch means for selectively applying electrical excitation pulses between the elongated electrodes for exciting ions within said trapping volume and for detecting image currents induced by ions in said trapping volume responsive to motion created by said excitation pulses.

10. An ion cyclotron resonance cell as in claim 9 in which the elongated electrodes are concentric.

11. An ion cyclotron resonance as in claim 10 in which the elongated electrodes are cylindrical.

12. An ion cyclotron resonance cell as in claim 10 in which the elongated electrodes are multi-sided.

* * * * *